United States Patent [19]

Srzanna

[11] Patent Number: 4,926,720

[45] Date of Patent: May 22, 1990

[54] RACHET SPANNER WITH OPEN MOUTH

[75] Inventor: Kurt Srzanna, Berlin, Fed. Rep. of Germany

[73] Assignee: Peter Wolter, Leonberg, Fed. Rep. of Germany

[21] Appl. No.: 256,200

[22] Filed: Oct. 11, 1988

Related U.S. Application Data

[63] Continuation of Ser. No. 24,303, Mar. 10, 1987, abandoned.

[30] Foreign Application Priority Data

Mar. 15, 1986 [DE] Fed. Rep. of Germany ..... 3609118
Mar. 25, 1986 [DE] Fed. Rep. of Germany ..... 3610508

[51] Int. Cl.[5] ..... B25B 15/04
[52] U.S. Cl. ..... 81/61
[58] Field of Search ..... 81/61, 62, 63, 59, 58, 81/60

[56] References Cited

U.S. PATENT DOCUMENTS

| | | | |
|---|---|---|---|
| 302,659 | 7/1884 | Hunter | 81/60 |
| 763,105 | 6/1904 | Morrison | 81/61 |
| 2,205,769 | 6/1940 | Sweetland | 81/492 |
| 2,376,575 | 5/1945 | Cronan . | |
| 2,456,838 | 12/1948 | Peterson | 81/61 |
| 2,760,394 | 8/1956 | Wragge . | |
| 3,444,767 | 5/1969 | Cupler . | |
| 3,504,579 | 4/1970 | Harlan . | |
| 3,572,188 | 3/1971 | Christian . | |
| 4,466,523 | 8/1984 | DeCarolis . | |

FOREIGN PATENT DOCUMENTS

| | | | |
|---|---|---|---|
| 1052141 | 4/1979 | Canada | 81/61 |
| 0099200 | 1/1984 | European Pat. Off. . | |
| 0835877 | 4/1952 | Fed. Rep. of Germany | 81/60 |
| 951708 | 10/1956 | Fed. Rep. of Germany . | |
| 1150930 | 6/1963 | Fed. Rep. of Germany . | |
| 3129710 | 2/1983 | Fed. Rep. of Germany | 81/60 |
| 2408431 | 6/1979 | France . | |
| 461510 | 9/1936 | United Kingdom | 81/61 |
| 0648163 | 12/1950 | United Kingdom | 81/60 |

*Primary Examiner*—Frederick R. Schmidt
*Assistant Examiner*—Blynn Shideler
*Attorney, Agent, or Firm*—Spencer & Frank

[57] ABSTRACT

A ratchet spanner includes a handle; an arcuate jaw-like head connected with the handle, the jaw-like head including a side wall defining a space therein, an upper wall, a lower wall, a plurality of first apertures in the upper wall and a plurality of second apertures in the lower wall in alignment with the first apertures; a plurality of pawls; a plurality of posts, each secured to a respective one of the pawls for pivotally mounting the respective pawl in a first aperture and second aperture in the jaw-like head adjacent the side wall; a ratchet insert member positioned with the space and rotatable with respect to the jaw-like head, the ratchet insert member including a plurality of teeth engageable by the pawls, and spaced gripping surfaces; and a sheet-like arcuate strip of sheet metal positioned against the side wall and a plurality of leaf spring members partially cut-out from the arcuate strip and biased into engagement with the pawls to pivot the pawls into engagement with the teeth.

21 Claims, 5 Drawing Sheets

FIG. 1
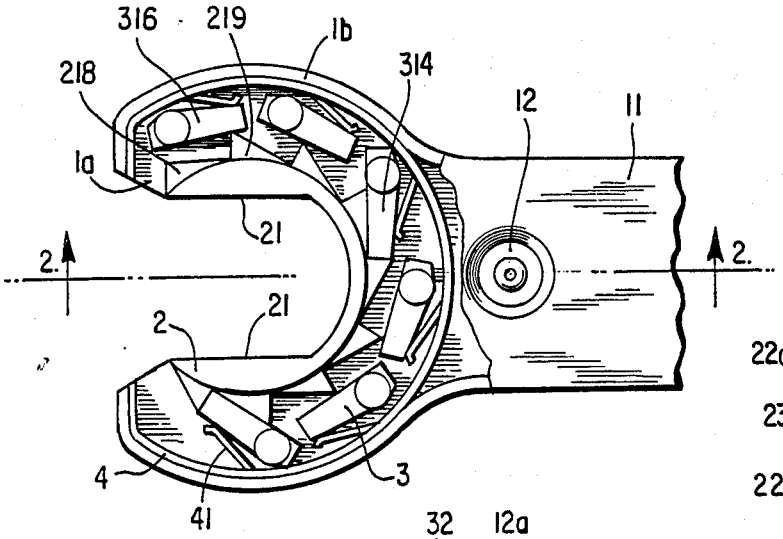
FIG. 3
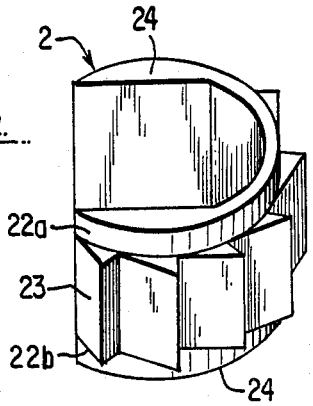
FIG. 2
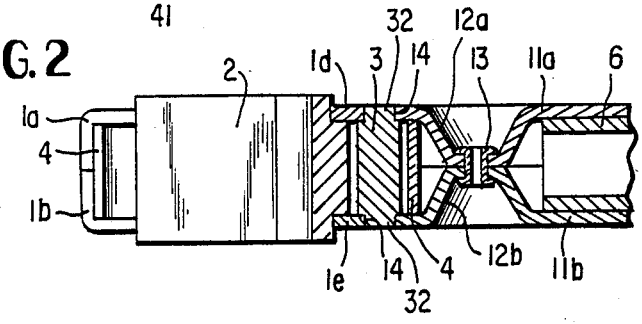
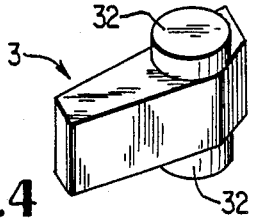
FIG. 4
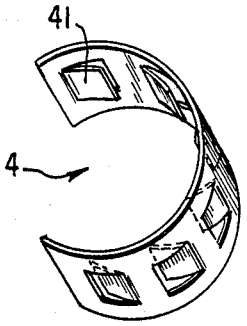
FIG. 5
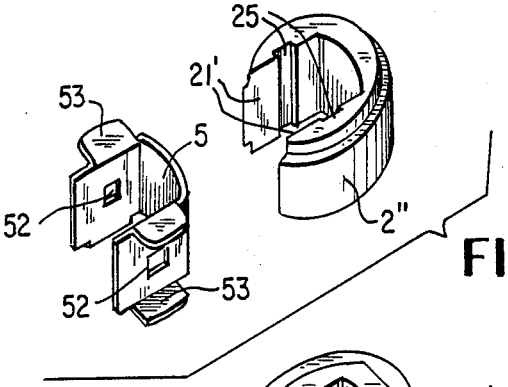
FIG. 6
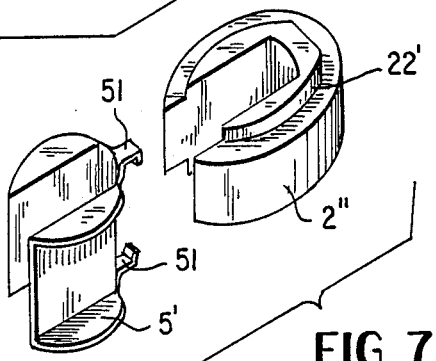
FIG. 7
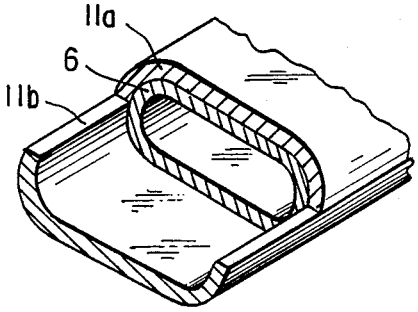
FIG. 8

FIG. 11
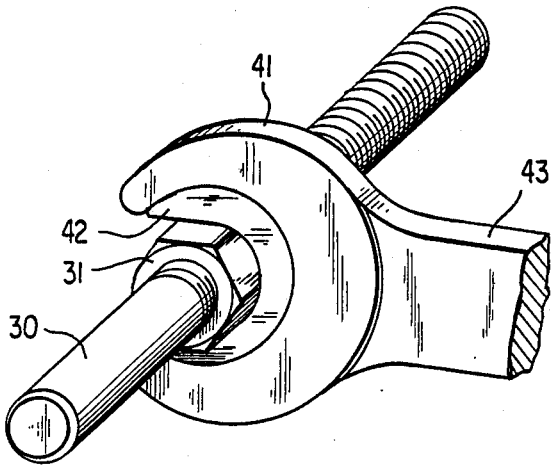
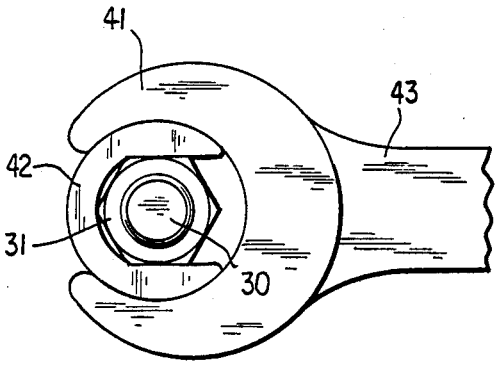
FIG. 12
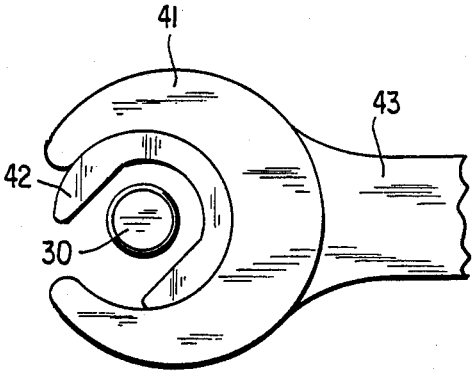
FIG. 13
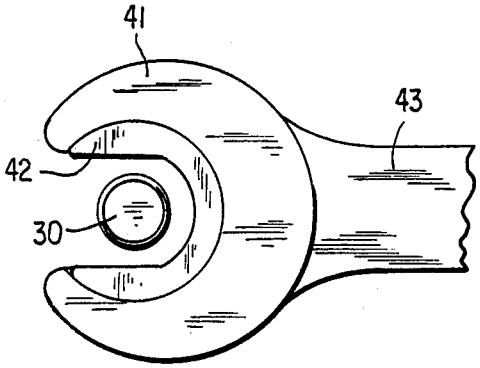
FIG. 14

RACHET SPANNER WITH OPEN MOUTH

This application is a continuation of application Ser. No. 07/024,303, filed on March 10, 1987 now abandoned.

BACKGROUND OF THE INVENTION

This invention relates generally to wrenches and, more particularly, is directed to an open ended ratchet spanner.

In many tight fitting situations, it is difficult to use a conventional ratchet wrench. Therefore, a conventional open ended wrench must be used. However, in tightening a bolt, for example, the wrench must continuously be removed from the bolt head (or nut) and then replaced thereon at a different angle for tightening or loosening the same. This procedure is continued until the bolt is tightened or loosened. In other words, the spanner arm can only be turned a few degrees at a time.

In this regard, open ended ratchet spanners have been developed having a configuration similar to open ended wrenches, and which can thereby fit within such tight spaces. For example, U.S. Pat. Nos. 1,169,007; 2,376,575 and 2,760,394 disclose such a ratchet spanner having an arcuate jaw-like head connected with a handle. The jaw-like head includes a substantially continuous, arcuate, inner side wall having a plurality of pockets, each receiving a pawl. A ratchet insert member having a plurality of teeth is positioned in the space defined by the inner side wall, with the pawls being engageable with the teeth to provide a ratchet operation, with each of the pawls being spring biased into engagement with the teeth. Specifically, a separate coil spring is separately associated with each pawl for normally biasing that pawl in a direction into engagement with the teeth of the ratchet member. As will be appreciated, particularly from U.S. Pat. No. 2,760,394, where there are a plurality of pawls, it becomes cumbersome, time consuming and expensive to individually set the coil springs with respect to the pawls. In addition, with such known ratchet spanners having an open jaw configuration, and within certain ranges of friction when turning the bolt or nut, the pawls tend to lock with the teeth, and because of the high spring pressure of the coil springs, do not release again. As a result, there is no ratchet action, and the bolt or nut turns with the spanner. Therefore, the ratchet spanner must be removed from the bolt or nut in order to remedy the same. Such high spring pressure presents still another disadvantage. Specifically, the ratchet spanner cannot be removed radially from the nut or bolt until the ratchet insert member is rotated to a predetermined angle with respect to the jaw-like head, so as to provide an open end to the spanner. However, due to the high spring pressure, this cannot be performed without the use of an additional tool.

However, biasing the pawls only by coil springs as in the DE-PS 3,129,710 corresponds practically to positioning in a free floating manner and may result in inaccuracies in alignment, and difficulties in removing the pawls from engagement with the teeth.

Further in these known ratchet spanners with an open jaw the locking of the pawls into the tooth gaps must be performed under relative high contact pressure of the flexible structural parts which may lead to the following problems.

1. When reaching a given frictional end position the pawls lock, but because of the strong spring pressure they do not release again, so that during the actuating of the ratchet spanner arm the nut and the structural part to be screwed on follow the reciprocal movement of the ratchet spanner arm, and no turning around of the structural part can be achieved;
2. During at least some operations the nut will assume an end position which enables a radial removal of the tool only in case the nut, after being axially removed from the work piece, is manually pivoted to such an extent that its jaw is flush with the spanner head. However this cannot be performed without the use of an additional tool due to the high spring pressure which blocks the nut.

Finally in German Patent 835,877 a ratchet spanner is disclosed in which the pawls are substituted by leaf springs being themselves the arresting or ratchet means which is clearly unsuitable in case that high torque stresses are applied.

OBJECTS AND SUMMARY OF THE INVENTION

Accordingly, it is an object of the present invention to provide a ratchet spanner that overcomes the problems encountered with the prior art.

It is another object of the present invention to provide a ratchet spanner in which the pawls are pivotally mounted in the jaw-like head.

It is still another object of the present invention to provide a ratchet spanner that substantially reduces locking of the pawls with the teeth of the ratchet insert member.

It is yet another object of the present invention to provide a ratchet spanner in which the pawls are spring biased into engagement with the teeth.

It is a further object of the present invention to provide a ratchet spanner in which assembly of spring biasing means for biasing the pawls into engagement with the teeth is relatively easy and economical.

Finally it is an object of the present invention to provide a ratchet spanner which is able to transmit high torques despite the interrupted teeth locking originating from the jaw opening and which also permits operation with only very small free actuating angles.

In accordance with a first-aspect of the present invention, a ratchet spanner includes a handle; an arcuate jaw-like head connected with the handle, the jaw-like head including a side wall defining a space therein, an upper wall, a lower wall, a plurality of first apertures in the upper wall and a plurality of second apertures in the lower wall in alignment with the first apertures in the upper wall; a plurality of pawls; a plurality of posts, each secured to a respective one of the pawls for pivotally mounting the respective pawl in a first aperture and a second aperture in the jaw-like head adjacent the side wall; a ratchet insert member positioned within the space and rotatable with respect to the jaw-like head, the ratchet insert member including a plurality of teeth engageable by the pawls, and spaced gripping surfaces; and spring biasing means for biasing the pawls into operative engagement with the teeth.

In accordance with another aspect of the present invention, a ratchet spanner includes a handle; an arcuate jaw-like head connected with the handle, the jaw-like head including a side wall defining a space therein; a plurality of pawls pivotally mounted in the jaw-like head adjacent the side wall; a ratchet insert member positioned within the space and rotatable with respect to the jaw-like head, the ratchet insert member including a plurality of teeth engageable by the pawls, and spaced gripping surfaces; and spring biasing means for biasing the pawls into operative engagement with the teeth, the spring biasing means including a sheet-like, arcuate member positioned against the side wall and a plurality of spring members partially cut-out from the arcuate member and biased into engagement with the pawls to pivot the pawls into engagement with the teeth.

In accordance with still another aspect of the present invention, a ratchet spanner includes a handle; an arcuate jaw-like head connected with the handle, the jaw-like head including a side wall defining a space therein, an upper wall, a lower wall, a plurality of first apertures in the upper wall and a plurality of second apertures in the lower wall; a plurality of pawls; a plurality of posts, each secured to a respective one of the pawls for pivotally mounting the respective pawl in a first aperture and a second aperture in the jaw-like head adjacent the side wall; a ratchet insert member positioned within the space and rotatable with respect to the jaw-like head, the ratchet insert member including a plurality of teeth engageable by the pawls, and spaced gripping surfaces; and spring biasing means for biasing the pawls into operative engagement with the teeth, the spring biasing means including a sheet-like, arcuate member positioned against the side wall and a plurality of spring members partially cut-out from the arcuate member and biased into engagement with the pawls to pivot the pawls into engagement with the teeth.

The above and other objects, features and advantages of the present invention will become readily apparent from the following detailed description thereof which is to read in connection with the accompanying drawings.

BRIEF DESCRIPTION OF THE DRAWINGS

FIG. 1 is a partially broken away, top plan view of a ratchet spanner according to one embodiment of the present invention;

FIG. 2 is a cross-sectional view of the ratchet spanner of FIG. 1, taken along line 2—2 thereof;

FIG. 3 is a perspective view of the ratchet insert member of the ratchet spanner of FIG. 1;

FIG. 4 is a perspective view of a pawl of the ratchet spanner of FIG. 1;

FIG. 5 is a perspective view of the spring biasing means of the ratchet spanner of FIG. 1;

FIG. 6 is a perspective view showing a modification of the ratchet insert member of the ratchet spanner of FIG. 1;

FIG. 7 is a perspective view showing another modification of the ratchet insert member of the ratchet spanner of FIG. 1; and FIG. 8 is a perspective view of a reinforcement assembly for the handle of the ratchet spanner of FIG. 1;

FIGS. 11 to 14 show various operating steps when using the ratchet spanner;

DETAILED DESCRIPTION OF A PREFERRED EMBODIMENT

Figure 9:
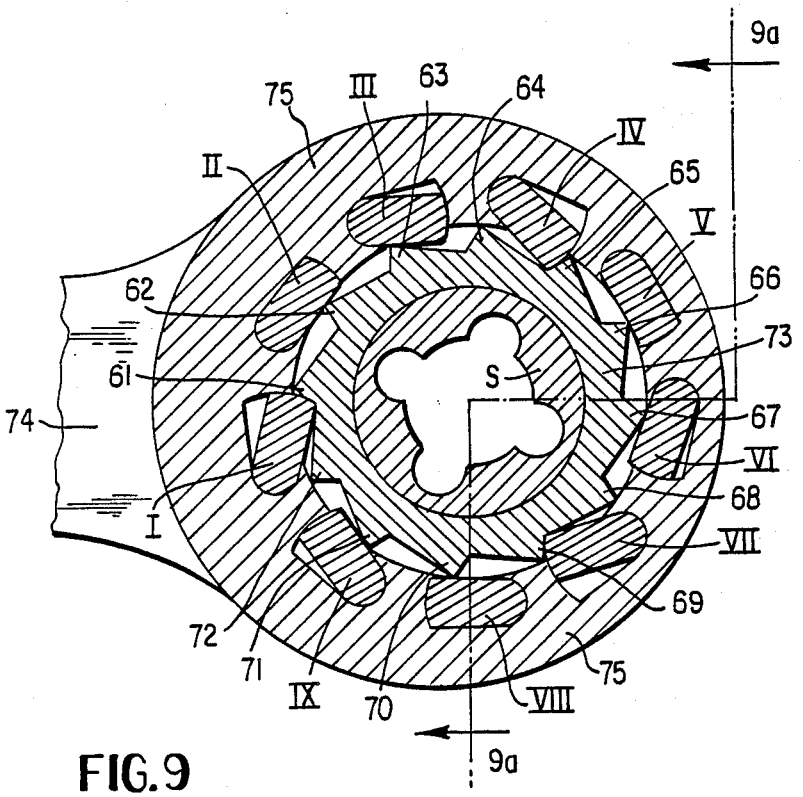
FIG. 9 is a cross sectional view of a ratchet spanner not forming part of the invention and used as starting point for explaining a special aspect of the invention.
Figure 9A:
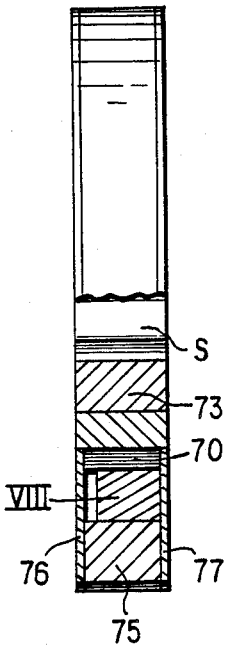

Referring to the drawings in detail, and initially to FIGS. 1 and 2 thereof, the ratchet spanner according to the present invention generally includes an arcuate, jaw-like head 1 having a substantially continuous side wall 1*b* which is open at one end 1*a* thereof and which defines a space 1*c* therein. Jaw-like head 1 is integrally formed with a handle 11 comprised of two molded half shells 11*a* and 11*b* made of a metal or synthetic plastic material, which half shells 11*a* and 11*b* are connected with each other by means of a rivet 13 within recesses 12*a* and 12*b*, respectively, thereof. In addition, as will be apparent from the description which follows, half shells 11*a* and 11*b* extend to the left of FIGS. 1 and 2 to form an upper wall 1*d* and a lower wall 1*e* of jaw-like head 1.

An arcuate ratchet insert member 2 is mounted in jaw-like head 1 and is provided with parallel inner jaw surfaces 21 for engaging with a bolt head, nut or the like. Ratchet insert member 2 is positioned within space 1*c* and is partially bounded by side wall 1*b*, upper wall 1*d* and lower wall 1*e*, as shown in FIGS. 1 and 2. As shown in FIG. 3, the external surface of ratchet insert member 2 is formed with upper and lower projections 22*a* and 22*b* extending circumferentially thereabout within a circular arc which is greater than 180°. Between projections 22*a* and 22*b*, a plurality of teeth 23 are formed on the external surface of ratchet insert member 2. In addition, the upper and lower surfaces 24 of ratchet insert member 2 are preferably provided with a knurling or other suitable grip which makes it relatively easy for the user to grasp the insert member to turn it with respect to jaw-like head 1 to an initial position.

In accordance with one aspect of the present invention, six pawls 3 are provided, although the present invention is not limited to this number, each pawl 3 having opposite cylindrical posts which form a vertical pivot pin 32 for pivotally mounting pawls 3 in apertures 14 formed in half shells 11*a* and 11*b* at positions circumferentially spaced about jaw-like head 1. In this manner, pawls 3 can be pivoted into engagement with teeth 23. Pawls 3 and ratchet insert member 2 can be made from plastic, ceramic or other rugged materials.

In order to bias pawls 3 into engagement with teeth 23, a thin, arcuate sheet-like member 4 is positioned between side wall 1*b* and pawls 3. Arcuate member 4 is stamped out at predetermined locations to form U-shaped leaf springs 41 which are each normally biased into engagement with a respective pawl 3 for biasing the latter into engagement with teeth 23. In this regard, arcuate member 4 performs a dual function, namely, normally biasing pawls 3 into engagement with teeth 23 and simultaneously, forming a reinforcing element for half shells 11*a* and 11*b* in the area of jaw-like head 1 so that high actuating forces can be transmitted. It is noted that, since teeth 23 are self-locking, only a relatively slight force need be experted on pawls 3, in order to move the same into engagement with teeth 23. Further, with this arrangement, it is not necessary to individually mount separate coil springs with respect to each pawl.

It can be seen from FIG. 1, that with the assembly according to the present invention, the pawl arrangement permits a renewed locking after 10° rotation, rather than 30° or 40° in accordance with the prior art. For example, during a return pivoting action in the clockwise direction, pawl 316 locks into the gap between teeth 218 and 219, so that it is only necessary to travel an angular extent of 10°. This is extremely important for operations in tight spaces where the angular movement of the ratchet spanner is greatly restricted. Thus, the present invention can be used in places where even conventional open-ended wrenches cannot be used. This is effectively achieved by providing that the angular spacing between teeth 23 is different than the angular spacing between pawls 3 and will be explained in detail later on.

In the specific case of FIG. 9, assuming a completely enclosed jaw-like head 1, there would be twelve power transmission points constituted by twelve teeth and nine pawls.

The angular extent "w" after which renewed locking takes place is given by the following equation:

$$w = \frac{360 \times q}{z1 \times z2}$$

where z1 is the total number of teeth and z2 the total number of pawls, assuming that the teeth and pawls extend around an angular extent of 360°. The value "q" is the largest common divider for the values of z1 and z2. In the present example, the full number z1 of teeth is 12, the full number z2 of pawls is nine and therefore the value of "q" is 3. Therefore, with these values, the angular extent "w" at which renewed locking occurs is equal to 10°. As a result, a very small after gripping path is obtained, while simultaneously, the number of teeth does not become too large.

It will be appreciated that the present invention differs from known ratchet spanners in operation. Specifically, the present invention merely biases pawls 3 against teeth 23, and teeth 23 displace pawls 3 during rotation of ratchet insert member 2, so that pawls 3 immediately lock into available gaps between teeth 23. This merely requires the application of a small spring force, for example, in the order of a fraction of a Newton, depending upon the mass of the pawl 3 and the friction caused by mounting pin 32. Therefore, the spring force that is required is low, so that rotation of ratchet insert member 2 is not obstructed, as in the case of the prior art which utilizes individual coil springs for retaining pawls 3 in the gaps between the teeth. In this regard, arcuate member 4 is preferably formed from a strip of sheet metal and is preferably formed with a radius which is greater than that of the inner surface of side wall **1*b* so that arcuate member 4 is engaged against side wall 1*b*** with a light, rattle free pressure. The strip of material may be made of steel, bronze, plastic or the like.

For releasing the ratchet spanner from a nut, bolt head or the like, the ratchet spanner is brought out of engagement with the nut, bolt or the like by an axial displacement thereof, for example, over the threads of the nut, and then the ratchet insert member 2 is turned to such an extent that the entire ratchet spanner can be removed. This is facilitated since removal is performed over the threads of the bolt having a diameter far below that of the ratchet spanner.

In accordance with a modification of the present invention, additional inserts 5 can be used with a ratchet insert member 2' for varying the distance between parallel jaw surfaces 21' for engagement with different size nuts, bolt heads or the like, as shown in FIG. 6. The teeth of ratchet insert member 2' are not shown in FIG. 6 for the sake of clarity. In this regard, the ratchet spanner can be used with more than one spanner width. In the embodiment of FIG. 6, jaw surfaces 21' are formed with vertical recesses 25, and the outer surfaces of the legs of U-shaped insert 5 are formed with projections 52, which can be formed by punching outwardly and which fit within recesses 25 to maintain insert 5 between jaw surfaces 21'. In order to restrict vertical movement in FIG. 6, the legs of U-shaped insert 5 are formed with outwardly projecting upper and lower wings 53 which engage over the upper surface of ratchet insert member 2' and below the lower surface of ratchet insert member 2'.

In another embodiment, as shown in FIG. 7, the connecting leg of U-shaped insert 5' is formed with clamp members 51 which engage over arcuate projections 22' of ratchet insert member 2''.

Thus, in both of the embodiments of FIGS. 6 and 7, inserts 5 or 5' can be yieldingly snapped into engagement with ratchet insert member 2' or 2'', either by projections 52 which snap into corresponding recesses 25 (FIG. 6), or by clamp members 51 which snap over projections 22. In this regard, recesses (not shown) can be provided in handle 11 for mounting a plurality of inserts 5 or 5' having different spanner dimensions for ready availability.

In accordance with another aspect of the present invention, in order to reinforce handle 11 and to safely connect half shells **11*a* and 11*b* without lateral displacement, even under the roughest handling of the ratchet spanner, handle 11 is preferably fitted with a flat pressed tube 6, as shown in FIGS. 2 and 8**.

Thus with the present invention, a slim open ended ratchet spanner is provided in which the pawls are pivotally mounted in the head and are biased into engagement with the teeth with minimal spring pressure by means of cut-outs in an accurate sheet-like member. As an example of the relative dimensions of the ratchet spanner according to the present invention, the ratio of the outer dimensions of head 1 to the width thereof is approximately 2.37:1, in comparison to a ratio of 2.28:1 for a conventional hexagon spanner. Therefore, the ratchet spanner according to the insert invention can fit in the same small spaces as a conventional wrench.

Now for better understanding of another advantageous aspect of the invention this is explained in view of the configuration of FIG. 9.

The illustrated ratchet spanner in this ringform known per se is used for rotating e.g. a thread cutter S. A ratchet head 75 connected to a lever is shown at the left side of FIG. 9 in plan view, and at the right side in a side view cut in half. It can be seen that the inner rotating chuck 73 and the associated workpiece, work tool or the like are taken along with the rotating movement in the clockwise direction in accordance to the free movement of the handle 74.

Due to ring like cover plates 76 and 77 being mounted on the upper and lower side of head 75 which support shoulders of chuck 73, it is fixed in the axial direction and can perform only rotating movements.

When pivoting the head 75 opposite to the clockwise direction, it rotates freely around the chuck with the associated locking teeth 61–72 due to the yielding of ratchet pawls I to IX which are pushed back by the chuck 73.

In the position illustrated in FIG. 9 the ratchet pawls I, IV and VII are in engagement with chuck.

To enable the ratchet spanner to be turned only a small angle counterclockwise, until a locking effect can be obtained when turning in the clockwise direction, the indexing or spacing ratio of the locking teeth of the chuck is different to that of the ratchet pawls. [Thereby, care has been taken that relative large torques may be transmitted without damaging the locking mechanism.] For this purpose a certain rotation symmetry is provided such that the location of the locked parts repeats after an offsetting of for example 120°.

Now ring-like chuck cannot be used everywhere. For example, two pipes cannot be connected with a coupling nut by means of such a ratchet spanner, if it is not possible to slide the ringlike chuck onto one of the pipes and to move it to the coupling nut, and after making the pipe connection to slide it off the pipes.

Figure 10:
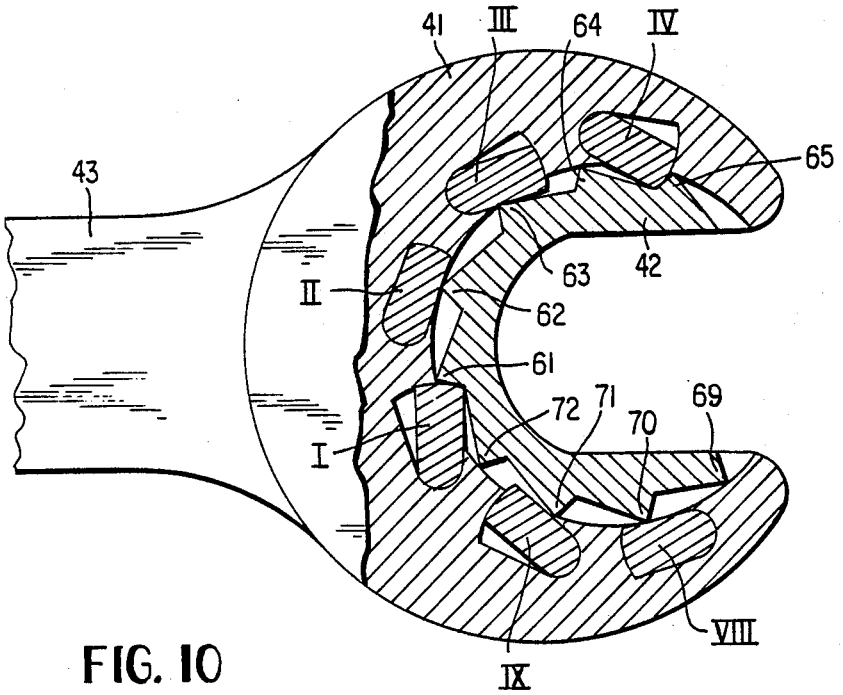
FIG. 10 is a cross sectional view of another embodiment of the invention.

The embodiment of FIG. 10 therefore secures a ratchet jaw spanner permitting an operation with only very small pivot angles according to the invention.

This embodiment invisages therefore a spacing ratio corresponding to any of the nonius ratios 3:4, 4:5, . . . 10:11 etc., or a multiple thereof, which is explained in more detail later on.

FIG. 10 does not show the cut out part of the locking teeth 61 to 72 of FIG. 9, due to the jaw like design of head 41' and chuck 42. The same holds true for a given part of the ratchet pawls I to IX. Only the locking teeth 61 to 65 and 69 to 72 as well as the ratchet pawls I to IV, VIII, IX remain. The cover plates are similarly cut out corresponding to the jaw cut.

It may be arranged to use the spanner reversely, that is, reversing the direction of operation. However, if such a device should be used for ratchet work in the clockwise direction, without being removed from the tool or the workpiece, the following steps can be taken:

Two superimposed inventive systems are used, wherein the one is designed for a left hand turning and the other for a right hand turning. A rotatable slotted ring is associated with the ratchet pawls which carry pins, whereby the ring pushes the ratchet pawls with a turning motion into their mounting position such that the associated chuck can freely rotate whereas in the reverse rotation of said ring, locking occurs again. From these two rings pins may extend through slots of the given cover plates in such a manner that the seat of the ratchet pawls can be manipulated from the outside.

The torque stresses of the device can still be increased if the slide flanks of the locking teeth are selected more steeply, so that the slide flank, for example, of locking tooth 64 abuts directly on the ratchet pawl IV in the illustrated position. Then the locking tooth 64 is no longer pointed but may support with its truncated end in the inner circle of head 41. In this manner the requirements for the stability of the chuck is relatively low, because a part of the forces acting on the chuck can be further transmitted to the jaw like head 41.

FIG. 11 illustrates a piece 30 of a pipe with a nut 31. The ratchet spanner can now be moved onto nut 31 either in the radial position (the jaws of the chuck 42 or the head 41 open in the same direction), or the ratchet spanner is at first kept over the pipe end 30 as illustrated in FIG. 14. The chuck 42 can then be turned for example into the position illustrated in FIG. 13, and the ratchet spanner can be pushed down onto nut 31. A closed position is illustrated in FIG. 12 in an axial plan view. When the nut 31 is sufficiently turned, there remain two possibilities:

either the jaws open in the same direction according to FIG. 11; then the ratchet spanner can be radially pulled off from nut 31, or the alignment of the jaws does not coincide, as shown in FIGS. 12 or 13; then the ratchet spanner is moved from the illustrated position of FIG. 12 first in an axial direction, until the chuck is no longer in engagement with the nut 31. Now the chuck 42 can be turned easily until the position of FIG. 11 is reached, and then be removed radially.

Figure 15:
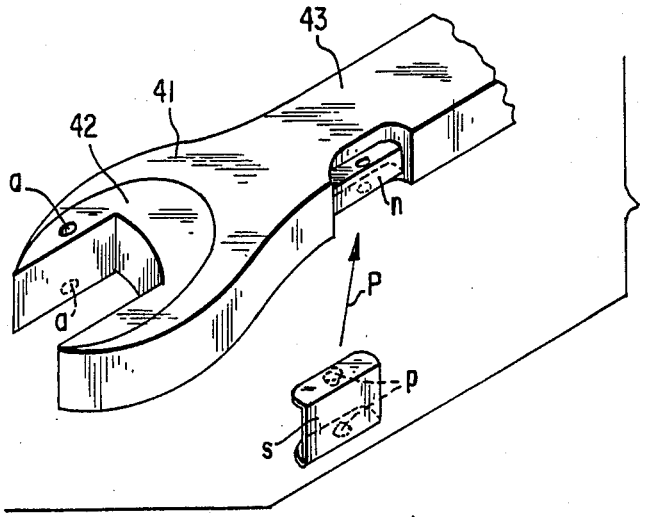
FIGS. 15 to 17 show still other modifications of ratchet insert members and FIGS. 18 and 19 show a schematic illustration of the succession of the engagements by means of the intermediary members in accordance with FIG. 1 and the same for the locking connections in accordance with FIG. 2, as well as the sequential succession of the engagements by means of the intermediary members in the case of aftergripping devices with a particular low aftergripping path.
Figure 16:
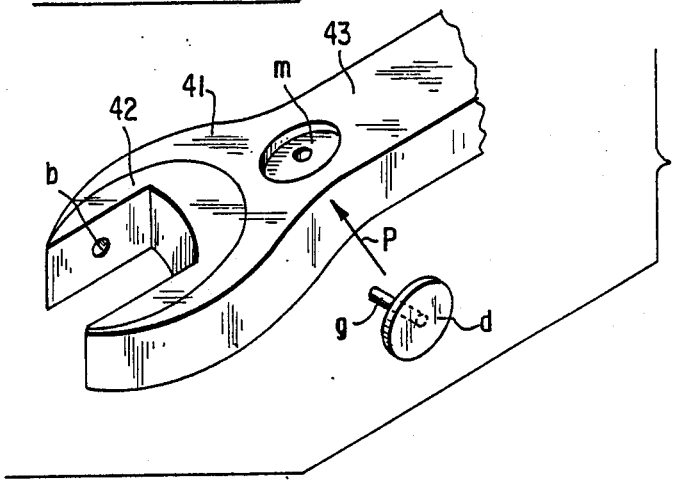
Figure 17:
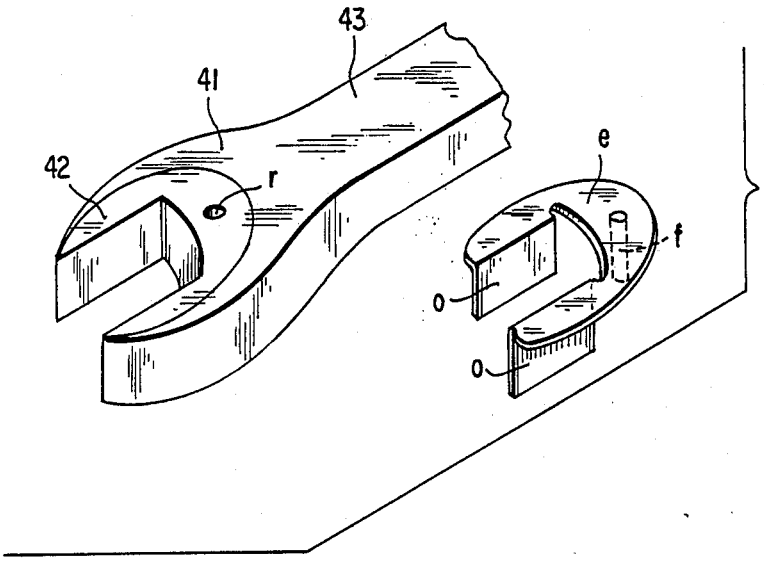

FIGS. 15 to 17 show further examples of insert members.

FIG. 15 illustrates a stamped part s which lines one of the flanks of chuck 42. For this purpose the chuck is provided on the upper and lower side in the proximity of the flank edges with cup shaped recesses a to be engaged by protrusions p of the U-shaped lining part s. When not in use this insert part s can be stored in a recess n of lever 43 as indicated by arrow P.

In FIG. 16 one of the flanks of chuck 42 receives in the flank center a thread bore b into which a thread extension g of a washer d is screwed. This or a plurality of these having different thicknesses may be removably mounted in recesses m of the insert part, as indicated in arrow P.

Again a stamped part is provided as an insert part in FIG. 17 with two parallel flanks o and a tubular distance pin f, which serves for retaining same in bore r of chuck 42.

Ratchet heads may be preferably provided on both ends of a spanner, thus forming a common system. The spacing ratios of insert part and locking mechanism are advantageously selected as explained in the following.

Figure 18:
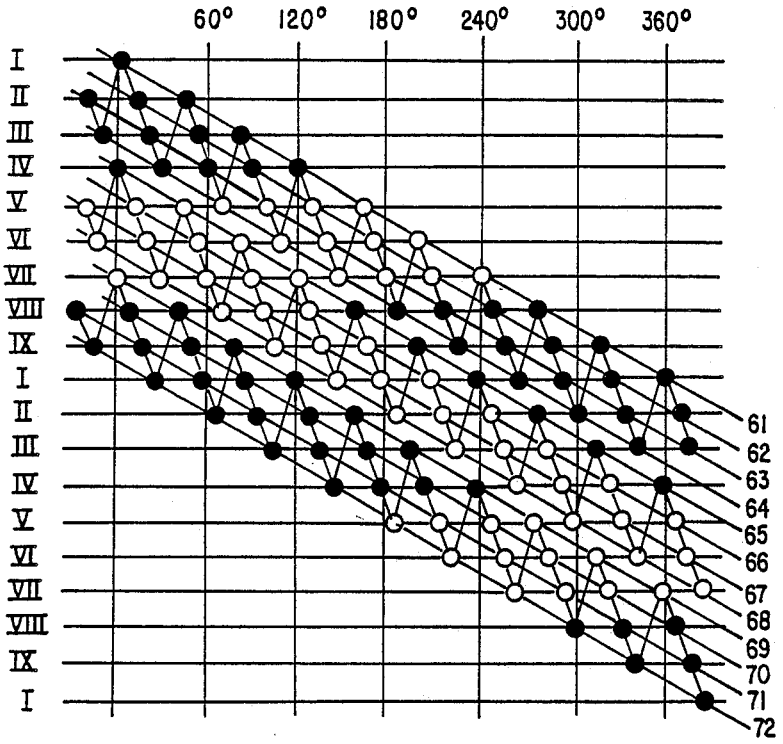
Figure 19:
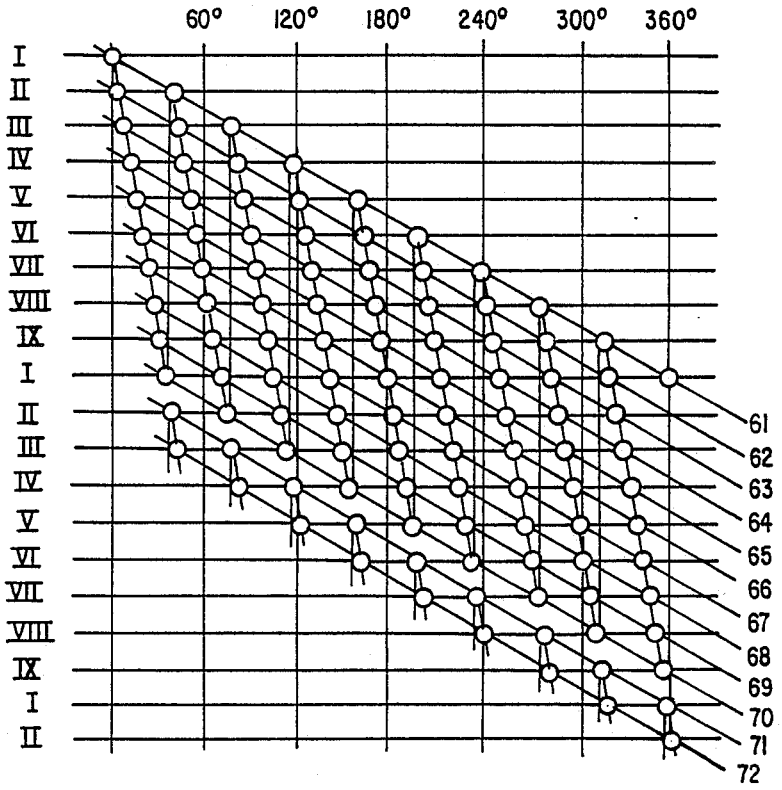

It can be seen from FIG. 9 that subsequent to the engagements 61/I, 65/IV and 69/VII the engagements 62/II, 66/V and 70/VIII follow; this is illustrated in more detail in FIGS. 18 and 19.

The automatic succession of the engagements during a ratchet/nut rotation is illustrated wherein the path of the intermediary members I–IX appear to be horizontal, the one of the teeth flanks (attacking points) 61–72 as diagonal and the progressive degrees of angles as vertically straight.

In this manner the grams of FIGS. 18 and 19 for the selected exemplified embodiment shows that the successive engagements are in series of three regular broken analog line trains, of which each can take the other's place; in the further course of the description this fact is of particular importance.

If one counts the engagements of such a group, it is shown that their number is neither 9 nor 12, but 36; this means that for the path of the manual lever one does not require 40° or 30°, but only 10°.

The diagram in accordance with FIG. 19 shows, that even smaller paths of movement can be generated despite an even smaller number of teeth and therefore more stable teeth, as may be required when using electromechanical tools which have a drive over only a particular small angle path. In order to obtain this, the number of the pawls has been maintained according to I–IX but only ten teeth 61–70 are provided.

Analogous to FIG. 18 in FIG. 19 the successive engagements are following each other in series in form of an interrupted train and are meeting each other in accordance with 61/I, 62/II, 63/III, 64/IV etc., then 61/II, 62/III, 63/IV . . . , then 61/III, 62/IV, 63/V etc.

By counting one finds that the number of the engagements during a rotation is about 90 and therefore the handle needs to be pivoted only by 4 angle degrees.

A corresponding calculation is:

$$w = \frac{360 \cdot q}{Z_1 \cdot Z_2}$$

(Path of the manipulation in angle degrees w equal 360 times q divided by the number of the attacking points $Z_1$ times the number of the intermediary members $Z_2$.)

Therein q denotes the largest of the common quotient for the two aforementioned numbers, it contains in the first selected example (number of teeth=12, number of intermediary members=9) the value 3.

In case of the second exemplified embodiment the sought pivot angle is calculated as follows:

$$w = \frac{360 \cdot 1}{10 \cdot 9} = 4 \text{ angle degrees}$$

Applied to the embodiment of FIG. 10 part of the attacking points (teeth) as well as a part of the pawls are then lacking in this example of a horse shoe shaped design of the spanner head 41 and nut 42.

For the operation of the embodiment of FIG. 10 only the teeth 61, 62, 63, 64, 65, 69, 70, 71 and 72 as well as the pawls I, II, III, IV, IX remain.

The cover plates contain a corresponding cut out, but they retain their function in such a manner that the nut 42 performs an exclusively secure rotating movement within the spanner head 41.

In FIG. 18 the blackened points show that the force transmission and the rotation of the nut within the spanner head remain secured, although no engagements occur any longer along the lines V, VI and VII as well as the lines 66, 67, and 68.

Having described specific preferred embodiments of the invention with reference to the accompanying drawings, it will be appreciated that the present invention is not limited to those precise embodiments, and that various changes and modifications may be effected therein by one of ordinary skill in the art without departing from the scope or spirit of the invention as defined by the appended claims.

What is claimed is:

1. A ratchet spanner comprising:

a handle;

said handle including a head portion having upper and lower walls defining a space therebetween, and an opening for engaging an element to be rotated, said head portion including a side wall bordering said space;

said upper wall having a plurality of first apertures and said lower wall having a like plurality of second apertures;

a plurality of pawls pivotally mounted in said head portion adjacent said side wall;

each of said plurality of pawls having at least a pair of integral support posts, one of said support posts on each pawl being received in a respective one of said plurality of first apertures and the other of said pair of support posts being received in a respective one of said plurality of second apertures, whereby each one of said plurality of pawls is mounted on said head portion for pivotal movement with respect thereto;

a ratchet insert member in said space and rotatable with respect to said head portion, said ratchet insert member including a plurality of teeth engageable by respective ones of said plurality of pawls, said ratchet insert member having spaced gripping surfaces adapted for gripping a nut or the like, and spring biasing means disposed in said space between said side wall and each of said plurality of pawls, said spring biasing means being engageable with said plurality of pawls for biasing each of said plurality of pawls into operative engagement with respective ones of said teeth, said spring biasing means including a sheet-like arcuate member adjoining said side wall having a plurality of spring members partially cut-out from said arcuate member which are biased into engagement with respective ones of said pawls to pivot each of said pawls into engagement with respective ones of said teeth.

2. A ratchet spanner according to claim 1, wherein said upper wall and lower wall form part of two half shells which also form said handle.

3. A ratchet spanner according to claim 2, further including a tube pressed between said half shells in said handle to prevent lateral displacement therebetween.

4. A ratchet spanner according to claim 1, further including at least one insert removably positioned between said gripping surfaces of said ratchet insert member for varying the dimensions therebetween.

5. A ratchet spanner according to claim 4, wherein each gripping surface has a recess therein, and each insert includes a projection which can be removably positioned within a respective recess for removably locking the insert to said ratchet insert member.

6. A ratchet spanner according to claim 4, wherein said ratchet insert member includes upper and lower projections, and each said insert includes clamp means for removably clamping said insert to the upper and lower projections.

7. A ratchet spanner according to claim 1, wherein said spring members are leaf spring members partially cut-out from said arcuate member.

8. A ratchet spanner as in claim 1, in which said spring is a leaf spring.

9. A ratchet spanner as in claim 1, in which respective ones of said first and second apertures are in alignment with each other, and said pair of posts extend in opposite directions from each other.

10. A ratchet spanner as claimed in claim 1, wherein said pawls and said teeth are distributed circumferentially at uniform distances, and a spacing of said teeth is different from a spacing of said pawls such that the ratio of said spacing of said teeth to said spacing of said pawls is represented by whole numbers according to a nonius ratio corresponding to one of 3:4, 4:5, 5:6, and so on, or a multiple thereof.

11. A ratchet spanner according to claim 10, wherein the spacing ratio of the pawls is at least 360°/9.

12. A ratchet spanner according to claim 10, wherein the spacing ratio of the locking teeth is at least 360°/12.

13. A ratchet spanner according to claim 10, wherein jaw-like heads are provided on both ends.

14. A ratchet spanner comprising:

a handle;

said handle including a head portion having a sidewall, an upper wall, and a lower wall defining a space therebetween, and an opening for engaging an element to be rotated;

said upper wall having a plurality of first apertures and said lower wall having a like plurality of second apertures;

a plurality of pawls adjacent said sidewall;

each of said plurality of pawls having at least a pair of integral support posts, one of said support posts on each of said plurality of pawls being received in a respective one of said plurality of first apertures and the other of said pair of posts on each of said plurality of pawls being received in a respective one of said plurality of second apertures, whereby each of said pawls is mounted on said head portion for pivotal movement with respect thereto;

a ratchet insert member in said space and rotatable with respect to said head portion, said ratchet insert member including a plurality of teeth engageable by corresponding ones of said plurality of pawls, said ratchet insert member having spaced gripping surfaces adapted for gripping a nut or the like, and spring biasing means adjacent said sidewall in said space engageable with said pawls for biasing said pawls into operative engagement with said teeth; said spring biasing means comprising an elongated strip having a plurality of extending projections which engage respective one of said plurality of pawls, said projections each extending from one surface of said strip away from said sidewall, the other surface of said elongated strip being in contact with said upper wall, said lower wall, and said sidewall of said handle so as to act as a supporting wall for supporting said upper and lower walls in spaced relationship, said elongated strip being retained within said handle against relative sliding movement to said head portion such that said projections resiliently bias respective ones of said plurality of pawls against respective ones of said teeth of said ratchet insert member; each of said projections, when resiliently deformed toward said sidewall by a respective one of said plurality of pawls, being resiliently biased away from said sidewall into engagement with said respective one of said plurality of pawls.

15. A ratchet spanner comprising:

a handle;

an arcuate jaw-like head connected with said handle, said jaw-like head including a side wall defining a space therein, an upper wall, a lower wall, a plurality of first apertures in said upper wall and a plurality of second apertures in said lower wall in alignment with the first apertures in said upper wall;

a plurality of pawls;

a plurality of posts, each secured to a respective one of said pawls for pivotally mounting the respective first pawl in a first and second aperture in said jaw-like head adjacent said side wall;

a ratchet insert member positioned within said space and rotatable with respect to said jaw-like head, said ratchet insert member including a plurality of teeth engageable by said pawls, and spaced gripping surfaces; and spring biasing means for biasing said pawls into operative engagement with said teeth, said spring biasing means including a sheet-like arcuate member positioned against said side wall and a plurality of spring members partially cut-out from said arcuate member and biased into engagement with said pawls to pivot said pawls into engagement with said teeth.

16. A ratchet spanner according to claim 15, wherein said spring members are leaf spring members partially cut-out from said arcuate member.

17. A ratchet spanner according to claim 15, wherein said upper wall and lower wall form part of two half shells which also form said handle.

18. A ratchet spanner according to claim 17, further including a tube pressed between said half shells in said handle to prevent lateral displacement therebetween.

19. A ratchet spanner according to claim 15, further including at least one insert removably positioned between said gripping surfaces of said ratchet insert member for varying the dimensions of said space.

20. A ratchet spanner according to claim 19, wherein each jaw surface has a recess therein, and each insert includes a projection which can be removably positioned within a respective recess for removably locking the insert to said ratchet insert member.

21. A ratchet spanner according to claim 19, wherein said ratchet insert member includes upper and lower projections, and each insert includes clamp means for removably clamping the insert to the upper and lower projections.

* * * * *

UNITED STATES PATENT AND TRADEMARK OFFICE

CERTIFICATE OF CORRECTION

PATENT NO. : 4,926,720

DATED : May 22nd, 1990

INVENTOR(S) : Kurt GRZANNA

It is certified that error appears in the above-identified patent and that said Letters Patent is hereby corrected as shown below:

On the title page under [19], second line and in item [75] the inventor's name should read --Grzanna--.

Signed and Sealed this

Tenth Day of September, 1991

*Attest:*

*Attesting Officer*

HARRY F. MANBECK, JR.

*Commissioner of Patents and Trademarks*